US010053787B2

(12) United States Patent
Madono et al.

(10) Patent No.: US 10,053,787 B2
(45) Date of Patent: Aug. 21, 2018

(54) ELECTROLYTIC CATHODE STRUCTURE AND ELECTROLYZER USING THE SAME

(75) Inventors: Akihiro Madono, Tamano (JP); Mitsumasa Okamoto, Tamano (JP)

(73) Assignee: DE NORA PERMELEC LTD, Fujisawa-Shi, Kanagawa (JP)

( * ) Notice: Subject to any disclaimer, the term of this patent is extended or adjusted under 35 U.S.C. 154(b) by 0 days.

(21) Appl. No.: 13/513,444

(22) PCT Filed: Jan. 5, 2011

(86) PCT No.: PCT/JP2011/050063

§ 371 (c)(1), (2), (4) Date: Jun. 1, 2012

(87) PCT Pub. No.: WO2012/032793

PCT Pub. Date: Mar. 15, 2012

(65) Prior Publication Data

US 2012/0241314 A1 Sep. 27, 2012

(30) Foreign Application Priority Data

Sep. 7, 2010 (JP) ..... 2010-200000

(51) Int. Cl.
*C25B 9/08* (2006.01)
*C25B 9/00* (2006.01)
(Continued)

(52) U.S. Cl.
CPC ..... *C25B 11/035* (2013.01)

(58) Field of Classification Search
CPC .. C25B 9/00; C25B 9/08; C25B 11/00; C25B 11/0431; C25B 11/0442; C25C 7/02; C25C 7/00; C25C 7/04
(Continued)

(56) References Cited

U.S. PATENT DOCUMENTS 4,288,506 A * 9/1981 Coetzer ..... H01M 4/58 205/57
4,343,690 A 8/1982 de Nora
(Continued)

FOREIGN PATENT DOCUMENTS

CN 101688318 A 6/2012
JP 57-032392 * 2/1982 ..... C25B 9/00

OTHER PUBLICATIONS

Office Action of Chinese Patent Application 201180009851.7 dated Nov. 26, 2014, 6 pages, Chinese Patent Office.
(Continued)

*Primary Examiner* — Zulmariam Mendez
(74) *Attorney, Agent, or Firm* — Greenblum & Bernstein, P.L.C.

(57) ABSTRACT

Provided are an electrolytic cathode structure that can suppress the degradation of an activated cathode even if a reverse current flows upon the stoppage of operation of an electrolyzer in an electrode structure allowing the distance between the electrode and an electrode current collector to be maintained at an approximately constant value, and an electrolyzer using the same.

The electrolytic cathode structure includes a metal elastic cushion member 1 compressed and accommodated between an activated cathode 2 and a cathode current collector 3. At least a surface layer of the cathode current collector 3 consumes a larger oxidation current per unit area than the activated cathode. The electrolyzer is partitioned by an ion exchange membrane into an anode chamber for accommodating an anode and a cathode chamber for accommodating a cathode. The electrolytic cathode structure is used for the cathode.

8 Claims, 3 Drawing Sheets

(51) Int. Cl.

| | |
|---|---|
| ***C25B 11/00*** | (2006.01) |
| ***C25C 7/02*** | (2006.01) |
| ***C25C 7/04*** | (2006.01) |
| ***C25B 11/03*** | (2006.01) |

(58) Field of Classification Search
USPC ..... 204/242, 252
See application file for complete search history.

(56) References Cited

U.S. PATENT DOCUMENTS

| | | | | |
|---|---|---|---|---|
| 4,539,083 | A | 9/1985 | Samejima et al. | |
| 4,917,976 | A * | 4/1990 | Wakihara | H01M 4/02 252/182.1 |
| 5,035,790 | A | 7/1991 | Morimoto et al. | |
| 5,459,517 | A | 10/1995 | Kunitake et al. | |
| 6,165,333 | A * | 12/2000 | Tanaka et al. | 204/282 |
| 8,309,259 | B2 * | 11/2012 | Friesen et al. | 429/402 |
| 8,372,255 | B2 * | 2/2013 | Perego et al. | 204/288.2 |
| 2004/0188245 | A1 * | 9/2004 | Katayama et al. | 204/252 |
| 2008/0230380 | A1 | 9/2008 | Ohsaka et al. | |
| 2009/0284229 | A1 | 11/2009 | Friesen et al. | |
| 2012/0048744 | A1 * | 3/2012 | Kim et al. | 205/342 |

OTHER PUBLICATIONS

European Search Report of PCT application 11823272.7 dated Dec. 23, 2014, 6 pages, European Patent Office.

* cited by examiner (b)

ELECTROLYTIC CATHODE STRUCTURE AND ELECTROLYZER USING THE SAME

TECHNICAL FIELD

The present invention relates to an electrolytic cathode structure and an electrolyzer using the same, and more particularly to an electrolytic cathode structure involved in the improvement of a cathode structure and an electrolyzer using the same.

BACKGROUND ART

In electrolyzers equipped with a cathode used for chlor-alkali electrolysis, usually, three components: an anode, an ion exchange membrane and a hydrogen generating cathode are arranged in close contact with each other to achieve decreased electrolysis voltage. However, in large electrolyzers having an electrolysis area as much as a few square meters, when accommodating an anode and a cathode as rigid members in an electrode chamber, it has been difficult to keep both electrodes in close contact with the ion exchange membrane and maintain an inter-electrode distance at a predetermined value.

Conventionally, as a method for closely contacting the three components: anode-ion exchange membrane-cathode with each other, there has been employed a method in which the pressure inside a cathode chamber is set higher than that inside an anode chamber to uniformly contact an ion exchange membrane with the anode, and then, a non-rigid material such as woven fabric, non-woven fabric or a net of thin metal wires, or a rigid material such as a leaf spring is arranged on a current collector on the back of the cathode to use its reaction force for close contact with the ion exchange membrane.

However, such a conventional non-rigid material has had drawbacks in that, when excessively pressed from the anode side after being installed into an electrolyzer, the non-rigid material is partially deformed and thereby causes the inter-electrode distance to be nonuniform or causes the thin wires to stab into the ion exchange membrane. In addition, rigid materials such as a leaf spring have had drawbacks in that they damage the ion exchange membrane or their reuse become impossible due to plastic deformation produced therein.

Thus, in Patent Document 1, there has been reported an electrolyzer in which, instead of such conventional materials, a metal coiled body was installed between a cathode and a cathode end plate to uniformly press the cathode in a diaphragm direction so as to keep respective members in close contact with each other. In the electrolyzer described in Patent Document 1, however, whereas the electrolyzer can be stably operated keeping the respective members in sufficiently close contact with each other because of an extremely small wire diameter of the metal coiled body and a high deformation rate thereof, there have been drawbacks in that the number of components increases due to installation of the metal coiled body in addition to the anode or the cathode in the electrolyzer and contact may become insufficient in case of a rigid cathode.

Accordingly, furthermore, Patent Document 2 has reported an electrolytic electrode in which, instead of using a metal coiled body to press an electrode in an ion exchange membrane direction, an elastic cushion member supporting an electrode catalyst formed by twisting a metal coiled body around an anticorrosive frame is applied to the electrode, and an electrolyzer using the same. The above electrolytic electrode maintains its configuration for a long period of time due to its high strength and toughness, it does not cause mechanical damage to the ion exchange membrane or the like and does not produce excessive deformation leading to insufficient power supply, so that stable operation can be continued for a long term. Moreover, the electrolyzer accommodating this electrode ensures the electrical connection between the electrode and an electrode current collector, thus allowing secure power supply.

RELATED ART REFERENCES

Patent Document

Patent Document 1: Japanese Examined Patent Application Publication No. S63-53272 (FIGS. 1 to 8)

Patent Document 2: Japanese Unexamined Patent Application Publication No. 2004-300543 (Claims, etc.)

SUMMARY OF THE INVENTION

Problem to be Solved by the Invention

The inter-electrode distance or the distance between the electrode and the electrode current collector has been able to be reduced and maintained at an approximately constant value by application of an elastic material composed of a conventional non-rigid material or rigid material between the electrode and the electrode current collector, application of the metal coiled body in Patent Document 1 achieving solution of the drawbacks of these materials and also a further improved technique described in Patent Document 2. These conventional electrode structures, however, have never been able to solve a problem in which the activated cathode is degraded when a reverse current flows into the electrolyzer due to operation stoppage or the like of the electrolyzer resulting from any plant trouble.

Therefore, it is an object of the present invention to provide an electrolytic cathode structure that can suppress the degradation of an activated cathode even if a reverse current flows into an electrolyzer in an electrode structure allowing the distance between the electrode and an electrode current collector to be maintained at an approximately constant value, and an electrolyzer using the same.

Means for Solving the Problem

In order to solve the above problem, the present inventors conducted investigation under an assumption that degradation of the activated cathode occurring when a reverse current flows into the electrolyzer may come from the elution of a component in a coating catalyst of the activated cathode due to anodic polarization of the activated cathode or the oxidation of an interface between a substrate and a catalyst coating film, and, as a result of the investigation, discovered the following. Specifically, the present inventors found out that, since the increased range of hydrogen overvoltage of the activated cathode becomes greater when the activated cathode is anodically polarized at a potential higher than the equilibrium potential of nickel-nickel hydroxide, even if a reverse current flows, performance degradation of the activated cathode can be suppressed to a minimum if activated cathode potential can be maintained to be a potential equal to or lower than the equilibrium potential. Regarding means for maintaining the potential, the present inventors also conducted extensive investigation to focus on that, for example, upon anodic polarization of a Raney nickel dispersion-plated activated cathode from a hydrogen generating potential, the activated cathode, due to its very large surface area, consumes an oxidation current as large as approximately 3 $F/m^2$ at the equilibrium potential of nickel-nickel hydroxide. As a result of that, the inventors found out that by producing an electrode structure as a three-layer structure of a cathode current collector, a metal elastic member and an activated cathode by using a member having a large surface area of nickel such as Raney nickel alloy for the cathode current collector, its reverse current consumption effect can prevent the activated cathode arranged forefront from the reverse current to allow the degradation of the activated cathode to be minimized, thereby completing the present invention.

Specifically, the present invention is characterized in that, in an electrolytic cathode structure in which a metal elastic cushion member is compressed and accommodated between an activated cathode and a cathode current collector, at least a surface layer of the cathode current collector consumes a larger oxidation current per unit area than the activated cathode.

In the electrolytic cathode structure according to the present invention, preferably, at least the surface layer of the cathode current collector is made of an active material capable of keeping a potential reached upon anodic polarization of the activated cathode at a potential equal to or lower than an equilibrium potential of nickel-nickel hydroxide.

In addition, in the electrolytic cathode structure according to the present invention, preferably, at least the surface layer of the cathode current collector is made of a metal selected from a group consisting of Raney nickel, Raney nickel alloy, activated carbon-nickel composite plating and hydrogen absorbing alloy-based dispersion plating, the metal being an active material electrochemically consuming a large oxidation current at a potential equal to or lower than the equilibrium potential of nickel-nickel hydroxide. Particularly preferably, at least the surface layer of the cathode current collector is made of Raney nickel, Raney nickel alloy or activated carbon-nickel composite plating.

In addition, in the electrolytic cathode structure according to the present invention, although the activated cathode is not restricted to any specific one, preferably the activated cathode has a thin but highly active catalyst coating film so that a highly flexible and thin cathode substrate can be selected and the catalyst coating film has a smooth surface so that the ion exchange membrane is not mechanically damaged. The activated cathode is, particularly preferably, a pyrolytic activated cathode selected from a group consisting of Ru—La—Pt based, Ru—Ce based, Pt—Ce based and Pt—Ni based cathodes.

In addition, in the electrolytic cathode structure according to the present invention, preferably, the metal elastic cushion member is a metal coil cushion, and particularly preferably is an elastic cushion member formed by twisting a metal coil around an anticorrosive frame.

Next, the electrolyzer according to the present invention is characterized in that in an electrolyzer partitioned by an ion exchange membrane into an anode chamber for accommodating an anode and a cathode chamber for accommodating a cathode, the electrolytic cathode structure is used for the cathode.

Advantages of the Invention

According to the present invention, in the electrode structure capable of maintaining the distance between the electrode and the electrode current collector at an approximately constant value, degradation of the activated cathode can be suppressed to a minimum even if a reverse current flows into the electrolyzer.

MODES FOR CARRYING OUT THE INVENTION

Hereafter, embodiments of the present invention will be described in detail with reference to the drawings.

Figure 1:
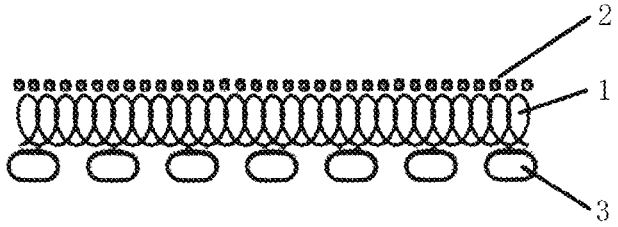
FIG. 1 is a schematic sectional view showing an example of an electrolytic cathode structure according to the present invention.

FIG. 1 shows a schematic sectional view concerning an example of the electrolytic cathode structure according to the present invention. As shown in the Figure, in the electrolytic cathode structure of the present invention, a metal elastic cushion member 1 is compressed and accommodated between an activated cathode 2 and a cathode current collector 3.

The electrolytic cathode structure of the present invention is characterized in that at least a surface layer of the cathode current collector 3 consumes a larger oxidation current per unit area than the activated cathode 2. Preferably, at least the surface layer of the cathode current collector 3 is made of an active material that can keep a potential reached upon anodic polarization of the activated cathode 2 at a potential equal to or lower than an equilibrium potential of nickel-nickel hydroxide. Specifically, in the electrolytic cathode structure of the present invention, when a reverse current flows due to stoppage of the electrolyzer, the active material forming at least the surface layer of the cathode current collector 3 preferentially consumes oxidation current to inhibit oxidation of the activated cathode 2 arranged forefront, so that the potential reached upon anodic polarization of the activated cathode 2 can be kept down to a potential equal to or lower than the equilibrium potential of nickel-nickel hydroxide. This can suppress to a minimum the oxidation of the activated cathode 2 associated with anodic polarization, allowing the degradation of cathode performance to be reduced.

In the present invention, preferably, the active material forming at least the surface layer of the cathode current collector 3 is a material that easily causes oxidation by a reverse current flowing upon operation stoppage of the electrolyzer and consumes electricity as much as possible by electrochemical oxidation reaction. Specific examples to be preferably used as such an active material include Raney nickel (Ni+Al), Raney nickel alloy (Raney nickel plus dissimilar metal element(s)), activated carbon-nickel composite plating and composite plating of hydrogen absorbing alloy particles. Among them, Raney nickel or Raney nickel alloy are more preferable, since these metals, which have a wide specific surface area and thus have a large contact area with a caustic alkali aqueous solution as a catholyte, can thus consume much reverse current. Additionally, the cathode current collector 3 may be of a plate-like shape, instead of being of a mesh-like shape as shown in the Figure, although the shape of the cathode current collector 3 is not restricted to a specific one. Furthermore, in the present invention, it is defined that at least the surface layer of the cathode current collector 3 is made of the above specific active material. The reason for this is that consumption effect of oxidation current can be obtained when at least the surface layer of the cathode current collector 3 is made of the above specific active material.

Additionally, in the present invention, preferably, at least the surface layer of the cathode current collector 3 consumes a large oxidation current at a potential equal to or lower than an equilibrium potential −0.75 V vs. Hg—HgO of nickel-nickel hydroxide. When the activated cathode 2 is anodically polarized at a potential higher than −0.75 V vs. Hg—HgO, the degree of degradation of the activated cathode 2 increases. Thus, from the viewpoint of minimizing the degradation of performance, it is preferable to keep a potential reached upon anodic polarization at a potential equal to or lower than −0.75 V vs. Hg/HgO. Furthermore, in the present invention, a substrate to be used for the cathode current collector may be made of a commonly used material such as stainless steel or copper, other than nickel.

The activated cathode 2 is pressed by the metal elastic cushion member 1 to be brought into contact with an ion exchange membrane and thus needs to be flexible. The activated cathode 2 involved in the present invention can be any as long as it is usually used for electrolysis. Preferably, the activated cathode 2 is a pyrolytic activated cathode selected from a group consisting of Ru—La—Pt based, Ru—Ce based, Pt—Ce based and Pt—Ni based cathodes, where the activated cathode has a thin but highly active catalyst coating film and does not mechanically damage the ion exchange membrane because the coating film has a smooth surface. Particularly, Ru—La—Pt based and Ru—Ce based cathodes mainly containing Ru easily cause a problem of ruthenium elution resulting from reverse current, so that application of the present invention is advantageous. The present invention can use a large amount of such an Ru-based catalyst material that is highly active and inexpensive, thereby allowing cost reduction to be achieved without degrading cathode performance. Moreover, regarding Pt—Ce based, Pt—Ni based cathodes and the like, which is said to be a lilatively strong against the reverse current, also, there can similarly be obtained inhibitory effects on their degradation due to oxidation current by applying the present invention.

The metal elastic cushion member 1 can be any as long as it is made of a metallic material and has elastic properties so that electricity can be fed by pressing the flexile activated cathode 2 against the ion exchange membrane. Specifically, for example, besides conventionally used non-rigid materials such as woven fabric, non-woven fabric or nets composed of thin metal wires and rigid materials such as a leaf spring, there can be used a metal coil cushion as shown in the Figure, which can be obtained by forming a metal wire material into a coil. Preferably, a metal coil cushion is used. The metal coil cushion is obtainable as follows: a wire rod, which is produced by coating a highly anticorrosive metal with a small inherent resistance, such as nickel, nickel alloy, stainless steel or silver, by means of plating with highly anticorrosive nickel or the like, is then formed into a spiral coil by roll processing. The section shape of the wire rod is, preferably, round, oval, rectangular with rounded corners, or the like.

Figure 2:
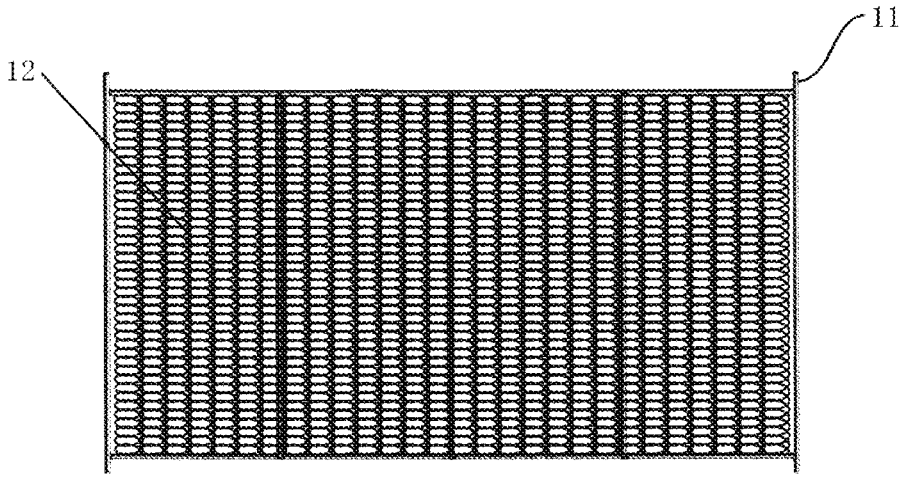
FIG. 2 (*a*) is a plane view showing an example of an elastic cushion member, and FIG. 2(*b*) is a plane view showing an example of an anticorrosive frame used for the elastic cushion member.
Figure 2:
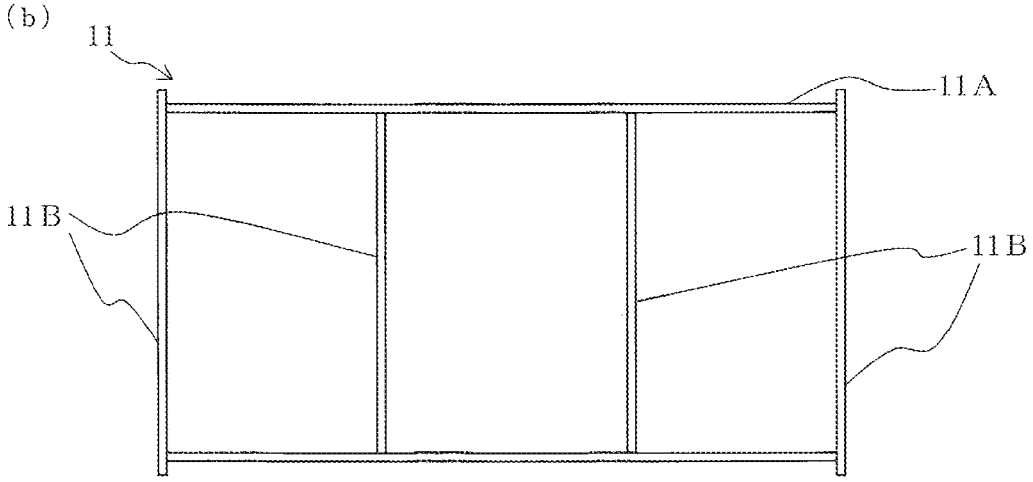

The metal coil cushion is preferably used as an elastic cushion member formed by twisting a metal coil thus obtained around an anticorrosive frame. FIG. 2(*a*) shows a plane view of an example of such an elastic cushion member, and FIG. 2(*b*) shows a plane view of an example of the anticorrosive frame used for the elastic cushion member. Herein, an anticorrosive frame 11 shown in FIG. 2(*b*) has a rectangular shape composed of frames 11A for retaining a coil and frames 11B bridged between the frames 11A to serve as reinforcement. The elastic cushion member shown in FIG. 2(*a*) can be produced by twisting one or plural pieces of metal coils 12 between the frames 11A of the anticorrosive frame 11 with an approximately uniform density. Regarding the elastic cushion member, in production or in theory, two layers of the metal coils are laminated on the right and left of the anticorrosive frame. However, since the metal coil itself is easily deformed, the adjacent coils are in practice engaged with each other in a comb-like manner, thereby seemingly forming a single layer. The elastic cushion member thus obtained has an appearance similar to a dishwashing metal scrubber. In addition, the anticorrosive frame can also be used as a structure in which the frames 11A are strongly attached to the cathode current collector 3 and, thereafter, the frames 11B are removed.

Using the elastic cushion member as the metal elastic cushion member 1 can provide an advantage that installation into any size of electrolyzer is possible by changing the size of the anticorrosive frame, arranging a plurality of pieces of the members, or the like. Additionally, since the anticorrosive frame 11 of the elastic cushion member has some strength, there is also an advantage that the elastic cushion member is easy to transport or carry and does not need any specific tool, skill or the like for its installation work or the like. Furthermore, the elastic cushion member is composed of a continuous metal wire material, where in a single anticorrosive frame, the metal wire material usually has only two ends and has no sharp cut surface. Accordingly, even when the elastic cushion member is used in the electrolytic cathode structure to be incorporated in the electrolyzer so that the member is in direct contact with the ion exchange membrane, the elastic cushion member does not cause any mechanical damage. Thus, it is possible to install the elastic cushion member as it is, without any need for processing of the ends of the metal wire member.

By incorporating the elastic cushion member into the electrolytic cathode structure, the diameter of the metal coil (an apparent diameter of the coil) is decreased by down to usually 10 to 70% to cause elasticity, by which the activated cathode 2 is pressed in a direction of the ion exchange membrane. Using a metal coiled body having a small wire diameter consequently increases the number of contact points between the elastic cushion member and the activated cathode 2, thus allowing uniform pressing. The elastic cushion member, after being incorporated into the electrolytic cathode structure or the electrolyzer, maintains its configuration by the anticorrosive frame. Therefore, the elastic cushion member is hardly subjected to plastic deformation, and in most cases, can be reused even when reconstructing the electrolyzer once dismantled.

The metal elastic cushion member 1 can be installed by directly welding the anticorrosive frame to the cathode current collector 3, or instead can be attached to the cathode current collector 3 using a fixing member such as a bolt or a screw by means of hole boring or threading. In any case, the metal elastic cushion member 1 can be freely installed and removed and there is no bother to install and remove it.

Figure 3:
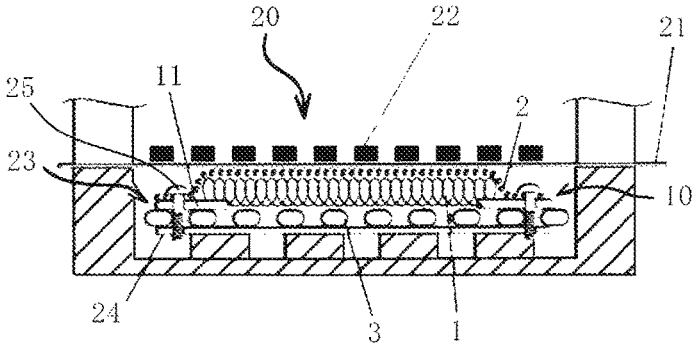
FIG. 3 is a schematic sectional view showing an example of an electrolyzer according to the present invention.

FIG. 3 shows a sectional view of an example of the electrolyzer according to the present invention. The electrolyzer shown in the Figure is partitioned by an ion exchange membrane 21 into an anode chamber 20 for accommodating an anode 22 and a cathode chamber 10 for accommodating a cathode 23. The electrolyzer of the present invention is characterized in that the electrolytic cathode structure of the present invention is used for the cathode 23. Thereby, even when a reverse current flows due to stoppage of the electrolyzer, the active material forming at least the surface layer of the cathode current collector 3 constituting the electrolytic cathode structure preferentially consumes oxidation current to inhibit the oxidation of the activated cathode 2, so that a potential reached upon anodic polarization of the activated cathode 2 can be kept down to a potential equal to or lower than an equilibrium potential of nickel-nickel hydroxide of the active material. Thereby, the oxidation of the activated cathode 2 associated with anodic polarization can be suppressed to a minimum to allow the degradation of cathode performance to be reduced.

The above electrolytic cathode structure can be installed into the electrolyzer of the present invention after constructing the electrolytic cathode structure, but it may be installed by sequentially installing the cathode current collector 3, the metal elastic cushion member 1 and the activated cathode 2 in the electrolyzer. Herein, a conventionally used cathode may be used as the cathode current collector 3. In this case, for example, an existing cathode that has been arranged in the electrolyzer may be used as the cathode current collector to sequentially install the metal elastic cushion member 1 and the activated cathode 2 thereon so as to construct the electrolytic cathode structure of the present invention. Additionally, when the metal elastic cushion member 1 is an elastic cushion member, the anticorrosive frame may be directly welded to the existing cathode, or when the existing cathode has a spring structure and is movable, a fixing plate 24 as shown in the Figure may be inserted thereinside to sequentially install the metal elastic cushion member 1 and the activated cathode 2 using a bolt 25 or the like via the fixing plate 24.

Desirably, electrolytic reaction in the electrolyzer of the present invention is production reaction of alkali hydroxide by chlor-alkali electrolysis, but is not particularly restricted as long as it is a reaction allowing the electrolytic cathode structure of the present invention to be used as the cathode. To perform the electrolysis of sodium chloride using the electrolyzer of the present invention, electricity is conducted between both electrodes while supplying an electrolytic such as a sodium chloride solution into the anode chamber and a dilute caustic soda solution into the cathode chamber. In the electrolyzer of the present invention using the electrolytic cathode structure of the invention including the cathode current collector 3, the metal elastic cushion member 1 and the activated cathode 2, there occur no mechanical damage to the ion exchange membrane or the like and no shortage of power supply due to excessive deformation, so that caustic soda and the like can be produced stably with high efficiency. In addition, even when the electrolyzer stops its operation, cathode performance degradation does not occur.

EXAMPLES

The present invention will now be described in more detail using Examples.

Experimental Example 1

In accordance with the following procedures, oxidation current was flown to cathode samples below to measure potential changes in the cathodes when anodically polarized. The potential changes were plotted with respect to the total amount of electricity of the flown reverse current to investigate oxidation properties of the cathode. The measurements were performed using 30 wt % NaOH as an electrolyte and a mesh-like nickel electrode as a counter electrode at a temperature of 90° C.

(Procedures)

(1) Preliminary electrolysis (cathodic polarization at 10 $kA/m^2$ for 1 hour).

(2) Starting of anodic polarization (obtaining of potential changes) (until 0V vs. Hg—HgO).

(3) Reelectrolysis (cathodic polarization at 10 $kA/m^2$ for 1 hour).

(4) (2) and (3) were repeated, and when anodic polarization was performed three times, the procedures were ended.

(Cathode Samples)

(A) A laminate of a mesh-like Raney nickel alloy electrode (mainly containing Ni and Al and including Ru—Ti), an elastic cushion member (formed by twisting a metal coil (material: nickel) around an anticorrosive frame (material: nickel)) and a micromesh-like activated cathode (Ru—La—Pt based pyrolytic activated cathode) (Example 1-1).

(B) A laminate of a mesh-like smooth nickel electrode, an elastic cushion member (formed by twisting a metal coil (material: nickel) around an anticorrosive frame (material: nickel)) and a micromesh-like activated cathode (an Ru—La—Pt based pyrolytic activated cathode) (Comparative Example 1-1).

(C) A micromesh-like activated cathode (an Ru—La—Pt based pyrolytic activated cathode) (Comparative Example 1-2).

(Test Results)

Figure 4:
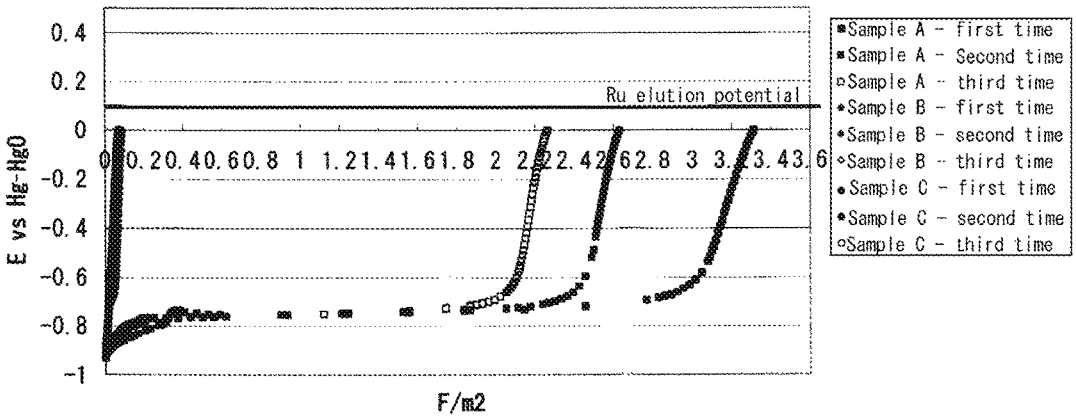
FIG. 4 is a graph showing plots of potential changes in cathodes with respect to the amounts of electricity upon anodic polarization in Examples.

FIG. 4 shows plots of potential changes in the cathodes with respect to the amount of electricity upon anodic polarization. The Ru elution potential in the Figure means a potential at which Ru begins to elute. As shown in FIG. 4, the cathode sample (A) of Example 1-1 having the cathode structure composed of the laminate of the cathode current collector, the metal elastic cushion member and the activated cathode and using the Raney nickel electrode as the cathode current collector has an amount of electricity of 2.2 $F/m^2$ to reach the Ru elution potential even when polarization has been performed three times. On the other hand, the cathode sample (B) of Comparative Example 1-1 using the usual nickel electrode as the cathode current collector and the cathode sample (C) of Comparative Example 1-2 using only the activated cathode have reached the Ru elution potential with an amount of electricity of approximately 0.06 to 0.08 $F/m^2$. It is shown that the cathode sample (A) of Example 1-1 consumes a large oxidation current, particularly near the equilibrium potential of nickel-nickel hydroxide (−0.75 V vs. Hg—HgO).

Gradual decrease in the amount of consumption of oxidation current by repeated anodic polarization seems due to that short reelectrolysis was performed at 10 $kA/m^2$ for 1 hour; reduction was insufficient; and Ni once oxidized was not completely reduced to Ni metal even when cathodically polarized again. Herein, in operation of a real electrolyzer, a case in which a reverse current flows most heavily is, for example, the stoppage of operation of a monopolar electrolyzer due to jumper ring operation. In this case, the anode and the cathode are in a complete short-circuit state and are exposed to the reverse current for a maximum of approximately 30 minutes until the circuit is opened. However, the total amount of electricity of the reverse current flown at that time is 0.65 F/$m^2$ per 30 minutes, and it is shown that, even under this condition, the cathode sample (A) of Example 1-1 is maintained at a potential equal to or lower than the equilibrium potential of nickel-nickel oxide for approximately 3 hours.

Experimental Example 2

To clarify the relationship between a potential reached upon anodic polarization and the degradation range of H.O.V, the cathode samples below were anodically polarized up to a predetermined potential in accordance with the following procedures to measure hydrogen overvoltages (H.O.V) before and after the anodic polarization. The measurements were performed using 30 wt % NaOH as an electrolyte and a mesh-like nickel electrode as a counter electrode at the temperature of 90° C.

(Procedures)

(1) Preliminary electrolysis (cathodic polarization at 10 kA/$m^2$ for 1 hour).

(2) Hydrogen overvoltage measurements.

(3) Anodic polarization up to a predetermined potential (−0.8 V, −0.7 V or −0.6 V vs. Hg—HgO).

(4) Reelectrolysis (cathodic polarization at 10 kA/$m^2$ for 1 hour).

(5) Hydrogen overvoltage measurements.

(6) (3) to (5) were repeated to measure hydrogen overvoltages after third-time anodic polarization, and then, the procedures were ended.

(Cathode Sample)

(D) Ru—La—Pt based pyrolytic activated cathode (no current collector).

(Test Results)

Figure 5:
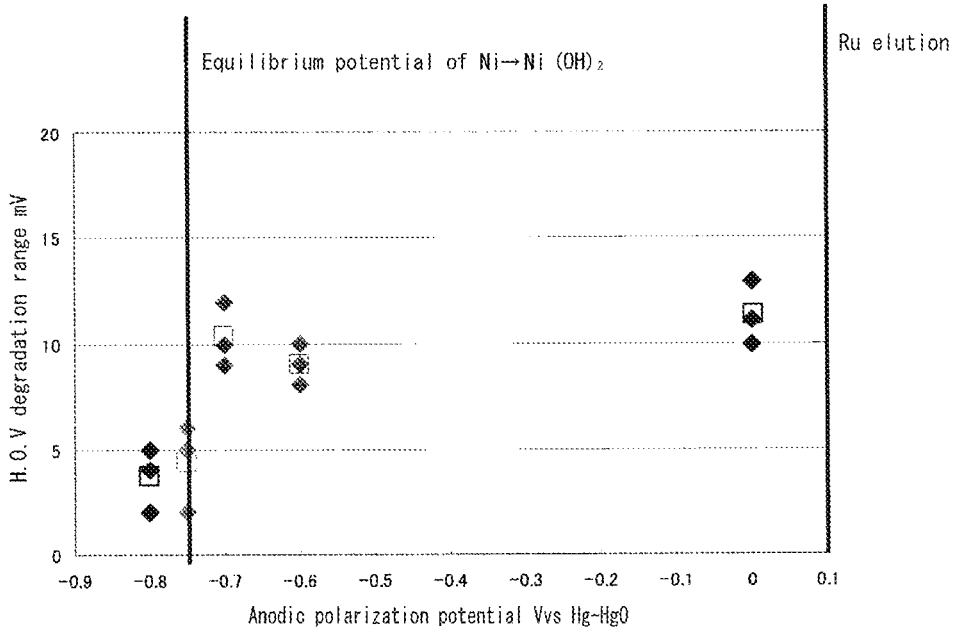
FIG. 5 is a graph showing plots of a degradation range of hydrogen overvoltage (H.O.V) with respect to a potential reached upon anodic polarization in Examples.

FIG. 5 shows plots of the degradation range of hydrogen overvoltages (H.O.V) with respect to potentials reached upon anodic polarization. In the Figure, the symbol ◆ indicates each of the three-time measurements and the symbol □ indicates a mean value thereof. As shown in FIG. 5, when the potential reached upon anodic polarization reaches a potential higher than the equilibrium potential of nickel-nickel hydroxide, namely when the cathode is anodically polarized up to the potential higher than −0.75 V vs. Hg—HgO, the degradation range obviously increases. Therefore, it has been determined that by maintaining a potential reached upon the anodic polarization of the activated cathode at a potential equal to or lower than the equilibrium potential of nickel-nickel hydroxide, cathode performance degradation of the Ru—La—Pt based pyrolytic activated cathode can be suppressed to a minimum.

Experimental Example 3

Using a testing compact electrolyzer having a size of 1 $dm^2$, there was performed short-circuit testing under assumption of the case in which a reverse current flows most heavily in a real machine (the case occurring due to jumper ring operation performed upon maintenance or the like of an electrolyzer) to compare cathode performances before and after the short-circuit testing. The anode used was a chlorine generating electrode with a substrate of titanium expanded metal (DSE JP-202 manufactured by PERMELEC ELECTRODE LTD.), and the ion exchange membrane used was N-2030 manufactured by Dupont Co., Ltd.

(Procedures)

(1) Under conditions of a current density of 6 kA/$m^2$ and a temperature of 90° C.±2° C., the electrolyzer was normally operated using 200±10 g/l of NaCl as an anolyte and 32±1 wt % of NaOH as a catholyte.

(2) A jumper cable was connected and a jumper switch was turned on (starting of short circuit).

(3) Under the following conditions, the electrolyzer was maintained for 1 hour to measure cathode potential and the amount of electricity of reverse current during the maintaining time. Removal of available chlorine: assuming a real machine, it was arranged such that chlorine was removed in approximately 30 minutes (since available chlorine in salt water of the anolyte makes the cathode at a higher potential during short circuit, salt water supply in the real machine is continued even after stoppage of operation to remove the available chlorine). Short-circuit time: 1 hour (a real machine does not take longer than 30 minutes). Temperature: it was maintained at 70° C. or higher.

(4) The jumper cable was removed, that is, the short circuit was cleared for reoperation.

(Cathode Samples)

(E) Raney nickel alloy-based activated cathode plus Ru—La—Pt based activated cathode (n=2).

(F) Activated carbon-nickel composite plating-based activated cathode plus Ru—La—Pt based activated cathode (n=2).

(G) Ru—La—Pt based activated cathode (n=2).

(Test Results)

Figure 6:
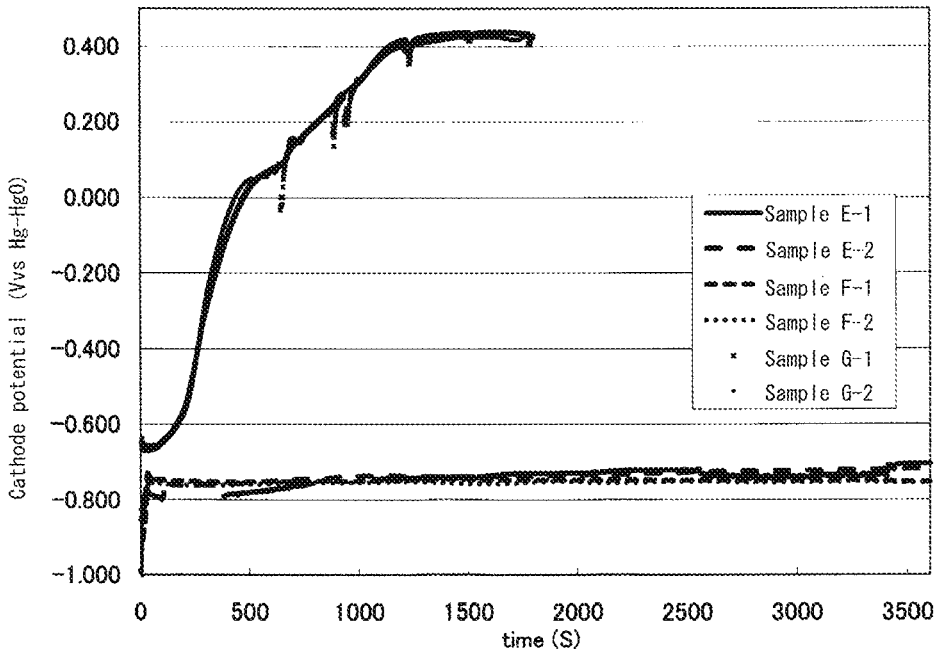
FIG. 6 is a graph showing potential changes in cathodes at short-circuit testing in Examples.

FIG. 6 shows a graph indicating potential behaviors of the cathodes upon the short-circuit testing. As shown in FIG. 6, during the 1-hour short-circuit time, the potentials of the cathode samples (E) and (F) as the laminate of the cathode current collector and the activated cathode stagnated near −0.75 V vs. Hg—HgO (the equilibrium potential of nickel-nickel hydroxide) and did not reach any potential higher than that. On the other hand, the cathode samples (G) using one-piece ordinary Ru—La—Pt based cathode reached an Ru elution potential in approximately 10 minutes. In real machine, the short-circuit state is not longer than 30 minutes, and available chlorine in the anolyte diffusing from the anode chamber to the cathode chamber through the ion exchange membrane to move the cathode potential to a higher level is discharged in 30 minutes. Thus, the present invention is thought to be sufficiently effective even in real machine.

In addition, as for performance changes before and after the short-circuit testing, in both of the two cathode samples (E) and (F), there was found no increase in cell voltage. Accordingly, since the cathode potential did not change to a potential side higher than −0.75 V vs. Hg—HgO, it was able to be confirmed that no performance degradation occurred also in the 1-$dm^2$ sized electrolyzer. On the other hand, in the cathode sample (G) using only the Ru—La—Pt based activated cathode, degradation has occurred even without Ru elution and the degradation range of the cathode sample has become larger when anodically polarized higher than −0.75 V vs. Hg—HgO.

DESCRIPTION OF SYMBOLS

1 metal elastic cushion member

2 activated cathode

3 cathode current collector
10 cathode chamber
11 anticorrosive frame
11A, 11B frame
12 metal coil
20 anode chamber
21 ion exchange membrane
22 anode
23 cathode
24 fixing member
25 bolt

The invention claimed is:

1. An electrolytic cathode structure in which a metal elastic cushion member is compressed and accommodated between an activated cathode and a cathode current collector, where a surface layer of the cathode current collector includes a material that consumes more than 0.08 $F/m^2$ oxidation current at lower than 0v vs. Hg—HgO potential in an alkaline solution, wherein at least the surface layer of the cathode current collector is made of activated carbon-nickel composite plating, and wherein at least a surface layer of the cathode current collector consumes a larger oxidation current per unit area than the activated cathode.

2. The electrolytic cathode structure according to claim 1, wherein the activated cathode is a pyrolytic activated cathode selected from a group consisting of Ru—La—Pt based, Ru—Ce based, Pt—Ce based and Pt—Ni based cathodes.

3. The electrolytic cathode structure according to claim 1, wherein the metal elastic cushion member is a metal coil cushion.

4. The electrolytic cathode structure according to claim 3, wherein the metal elastic cushion member is an elastic cushion member formed by twisting a metal coil around an anticorrosive frame.

5. The electrolytic cathode structure according to claim 1, the activated cathode is a pyrolytic activated cathode selected from a group consisting of Ru—La—Pt based, Ru—Ce based, Pt—Ce based and Pt—Ni based cathodes, and the metal elastic cushion member is an elastic cushion member formed by twisting a metal coil around an anticorrosive frame.

6. An electrolyzer partitioned by an ion exchange membrane into an anode chamber for accommodating an anode and a cathode chamber for accommodating a cathode, the electrolyzer being characterized in that the electrolytic cathode structure according to claim 1 is used for the cathode.

7. The electrolytic cathode structure according to claim 1, wherein the surface layer of the cathode current collector is easier to oxidize than the activated cathode, and the surface layer of the cathode current collector has a surface area that allows the cathode current collector to consume a larger oxidation current per unit area than the activated cathode.

8. An electrolytic cathode structure in which a metal elastic cushion member is compressed and accommodated between an activated cathode and a cathode current collector, where a surface layer of the cathode current collector includes a material that consumes more than 0.08 $F/m^2$ oxidation current at lower than 0v vs. Hg—HgO potential in an alkaline solution, wherein at least the surface layer of the cathode current collector is made of a metal of hydrogen absorbing alloy-based dispersion plating, and wherein at least a surface layer of the cathode current collector consumes a larger oxidation current per unit area than the activated cathode.

* * * * *